US007414514B2

(12) United States Patent
Hsu et al.

(10) Patent No.: US 7,414,514 B2
(45) Date of Patent: Aug. 19, 2008

(54) RESETTABLE CHIP-LIKE OVER-CURRENT PROTECTION DEVICES

(75) Inventors: Kang-Neng Hsu, Qionglin Shiang (TW); Kun-Huang Chang, Hsinchu (TW)

(73) Assignee: Inpaq Technology Co., Ltd., Taiwan (CN)

( * ) Notice: Subject to any disclaimer, the term of this patent is extended or adjusted under 35 U.S.C. 154(b) by 244 days.

(21) Appl. No.: 11/053,403

(22) Filed: Feb. 8, 2005

(65) Prior Publication Data

US 2006/0109076 A1 May 25, 2006

(30) Foreign Application Priority Data

Nov. 22, 2004 (TW) ..... 93135788 A

(51) Int. Cl.
*H01C 7/10* (2006.01)

(52) U.S. Cl. ..... 338/22 R; 338/203; 338/312

(58) Field of Classification Search ..... 338/13, 338/20, 21, 22 R, 25, 30, 68, 71, 72, 203–205, 338/312–314, 328, 332
See application file for complete search history.

(56) References Cited

U.S. PATENT DOCUMENTS 6,686,827 B2 * 2/2004 Chen et al. ..... 338/22 R

* cited by examiner

*Primary Examiner*—K. Richard Lee
(74) *Attorney, Agent, or Firm*—Ladas & Parry LLP

(57) ABSTRACT

The invention relates to resettable chip-type over-current protection devices and methods of making the same, characterized by directly forming upper and lower electrode conductor and connection electrode conductor on a PPTC substrate so as to constitute a simplified three-layer structure of "electrode conductor-PPTC substrate-electrode conductor."

4 Claims, 12 Drawing Sheets

RESETTABLE CHIP-LIKE OVER-CURRENT PROTECTION DEVICES

BACKGROUND OF THE INVENTION (A) Field of the Invention

The present invention relates to a structure and manufacturing method of an over-current protection device. More specifically, the present invention relates to a resettable chip-like over-current protection device utilizing a polymeric positive temperature coefficient (PPTC) material as a substrate thereof.

(B) Description of Related Art

PPTC devices have been widely used in circuits of electronic devices today. The conductive composite material used in the PPTC devices is mostly composed of polyethylene and electrically conductive particles (mostly carbon black). Under normal operating temperatures, polyethylene confines the conductive particles tightly in a crystalline structure thereby to form a low resistance conductive network. When an abnormally high current is present, the heat generated on the device will reform the polyethylene from crystalline to amorphous. In such a situation, confined conductive particles will be separated due to quick expansion of the polyethylene, which breaks original conductive network. As a result, the resistance rises quickly so that the abnormal current passing through the device will be limited. After termination of the abnormal current, the temperature of the device will drop to room temperature and the conductive composite material will return to the original structure, which means that the polyethylene again confines the conductive particles in the crystalline structure, forming a low resistance conductive network, whereby the purpose of automatic resetting is obtained.

Currently, PPTC devices are mostly used for the purpose of over-current protection. In additional to radial-leaded type devices similar to conventional fuses, the PPTC devices are applied to surface-mount type devices used in a printed circuit board (PCB), which is composed of an at least 5-layer structure of a PPTC substrate, two main electrode conductive metal foil on top and bottom surfaces of the substrate, and two surface connecting electrode layers. For instance, U.S. Pat. No. 6,292,088 (entitled "PTC Electrical Devices for Installation on Printed Circuit Boards") shown in FIG. 1A~FIG. 1F discloses that on a PPTC substrate 10, two main electrode conductive metal foils 11*a* and 11*b* are applied on two surfaces of the PPTC substrate firstly, as shown in FIG. 1A and FIG. 1B so as to form a sandwich structure as shown in FIG. 1C and FIG. 1D, then a via 12 necessary for connecting top and bottom electrode conductive layers is formed, as shown in FIG. 1E and FIG. 1F. Subsequently, a connecting electrode layer 13 is formed on the via 12, as shown in FIG. 1G and FIG. 1H. Then electrode isolation areas 14 required in installation of terminal electrodes of the chip-like resettable over-current protection device are formed, as shown in FIG. 1I and FIG. 1J. Finally, a finished substrate is separated into individual devices according to predetermined cutting lines 15 as shown in FIG. 1K and FIG. 1L, and then the chip-like resettable over-current protection device with two terminal electrodes 16 and 17 is finished. The said terminal electrodes 16 and 17 are isolated from each other but connected to themselves located on top and bottom surfaces.

After analyzing this prior art, it is understood that the prior art has the following drawbacks:

1. The structure of 5-layer "surface connecting electrode conductive layer-main electrode conductive metal foil-PPTC substrate-main electrode conductive metal foil-surface connecting electrode conductive layer" and the manufacturing method thereof are too complex.
2. In preparing the electrode isolation areas, parts of electrode conductive metal foils 11*a* and 11*b* on device need to be removed and this process consumes much power and produces pollution.

SUMMARY OF THE INVENTION

The present invention is a solution for eliminating the drawbacks mentioned in the prior art. According to the present invention, the purposes of reducing process steps, saving resources and mitigating pollution concern can be achieved.

The present invention mainly relates to a method of manufacturing a chip-like resettable over-current protection device, comprising the step of:

forming a plurality of vias on predetermined locations on a substrate of a PPTC material.

Subsequently any one of the following two processes can be performed:

Process 1

At least one metal interface layer is deposited on both surfaces of the substrate and walls of the vias by sputtering, electroless electroplating (such as chemical plating), or other chemical or physical processes (such as printing, projecting, and evaporation.) Then, a layer of conductive metal is formed on the metal interface layer for a thickness of at least 10 μm. Subsequently, at least one layer of conductive metal at predetermined locations on both surfaces of the substrate is removed so as to expose the substrate on locations of electrode isolation areas.

Process 2

A plurality of electrically isolated protective layers are deposited on predetermined locations of both surfaces of the substrate. The protective layers are covered by a mask of the same size in area. At least one metal interface layer is applied on both faces of the substrate and walls of the vias by sputtering, electro-less plating (such as chemical plating), or other chemical or physical processes (such as printing, spraying, evaporation, etc.). Then, a layer of conductive metal is deposited on the metal interface layer for a thickness of at least 10 μm. Subsequently, all the masks are removed.

Finally, the substrate is cut through a plurality of predetermined cutting lines so as to obtain a plurality of devices, wherein the cutting lines pass through the vias and make the inner walls of the vias become a part of side walls of each of the devices. The conductive inner walls are at locations of electrodes of the devices.

The manufacturing process is completed so far. The completed chip-like over-current protection device comprises a three-layer structure of electrode conductive layer-PPTC substrate-electrode conductive layer, which is simpler than the conventional five-layer structure. Besides, the present invention comprises the following advantages:

1. The prior art metal foil is not required.
2. The prior art sandwich structure manufacturing process is not required, so that time and energy is saved.

Because protective layers are applied on electrode isolation areas in advance, the process can be simplified by selectively processing areas in manufacturing the electrode conductive layer so as to simplify process, reduce resource consumption and mitigate pollution. Moreover, the protective layers are of the same thickness as electrode conductive layers, and the surface of the device will be flatter than conventional ones.

BRIEF DESCRIPTION OF THE DRAWINGS

FIG. 4A, FIG. 4C, FIG. 4E, FIG. 4G, FIG. 4I and FIG. 4K are top view of manufacturing steps of third embodiment of the present invention, wherein FIG. 4E and FIG. 4G are opposite faces of the same device at the same manufacturing step.

DETAILED DESCRIPTION OF THE INVENTION

Please refer to FIGS. 2A~FIG. 2J, FIG. 3A~FIG. 3J and FIG. 4A~FIG. 4M for procedure of implementation and structure of embodiments. The embodiments only illustrate possible methods for embodying the present invention so as to make the present invention easier to understand but not used to limit ways to embody the present invention. Persons skilled in the art can modify ways of embodying the present invention without departing from the scope and spirit of the present invention.

Figure 1A:
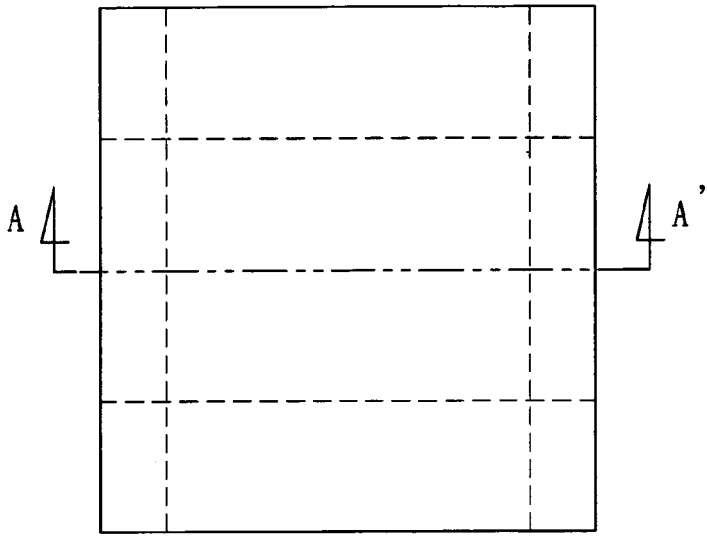
FIG. 1A (PRIOR ART)
FIG. 1A, FIG. 1C, FIG. 1E, FIG. 1G, FIG. 1I and FIG. 1K show structures obtained in manufacturing steps of a prior art device.
Figure 1B:
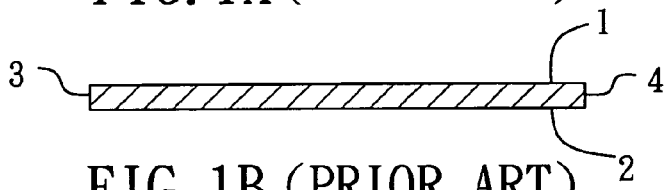
FIG. 1B (PRIOR ART)
FIG. 1B, FIG. 1D, FIG. 1F, FIG. 1H, FIG. 1J and FIG. 1L are cross-section view of FIG. 1A, FIG. 1C, FIG. 1E, FIG. 1G, FIG. 1I and FIG. 1K taken at line A-A', respectively.
Figure 1C:
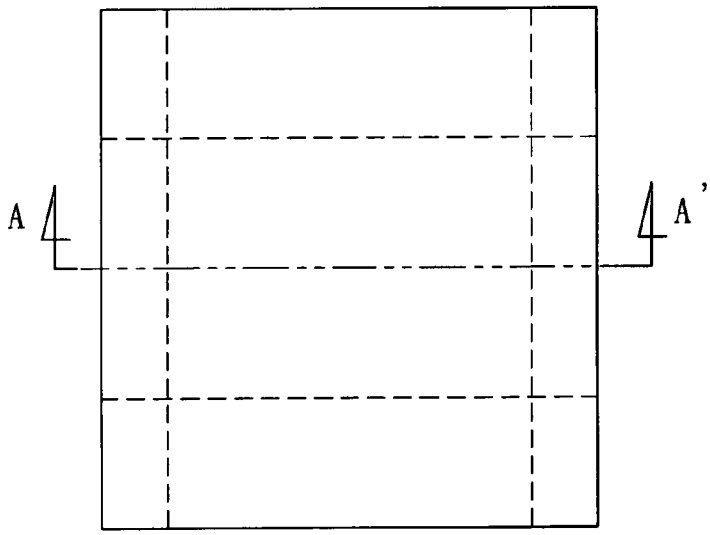
FIG. 1C (PRIOR ART)
Figure 1D:
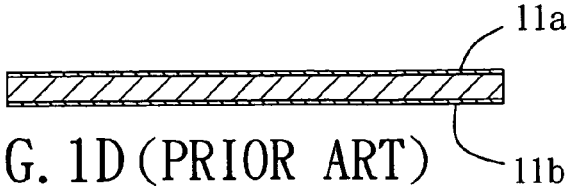
FIG. 1D (PRIOR ART)
Figure 1E:
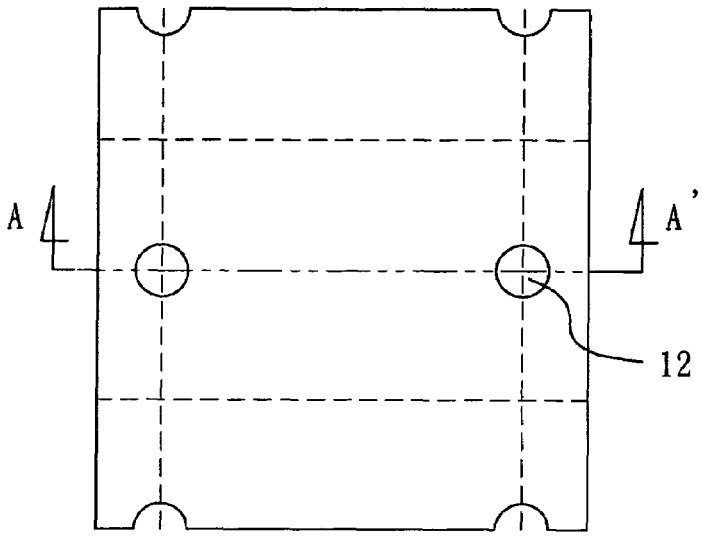
FIG. 1E (PRIOR ART)
Figure 1F:
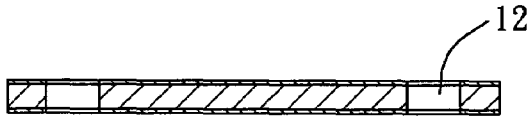
FIG. 1F (PRIOR ART)
Figure 1G:
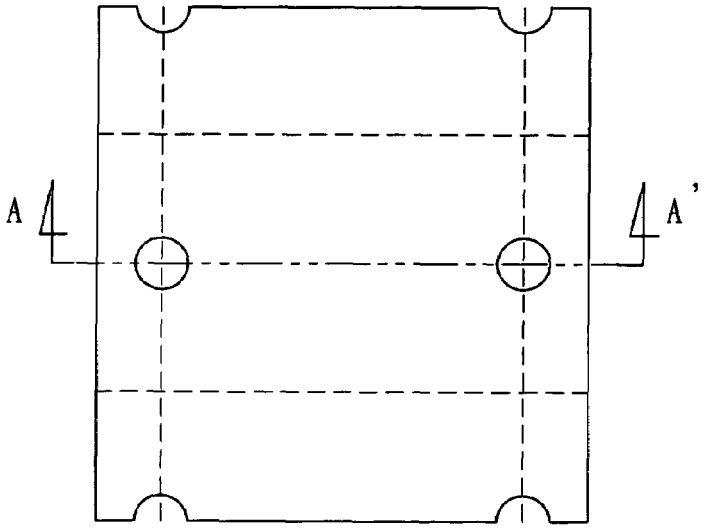
FIG. 1G (PRIOR ART)
Figure 1H:
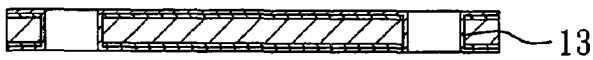
FIG. 1H (PRIOR ART)
Figure 1I:
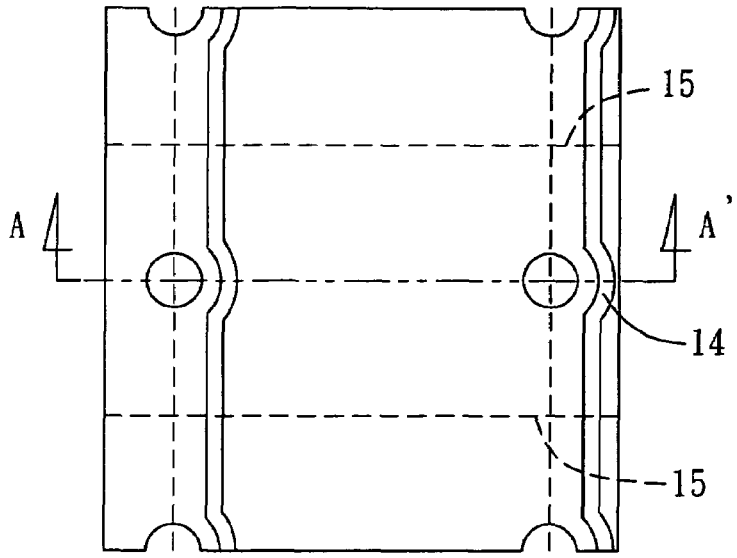
FIG. 1I (PRIOR ART)
Figure 1J:
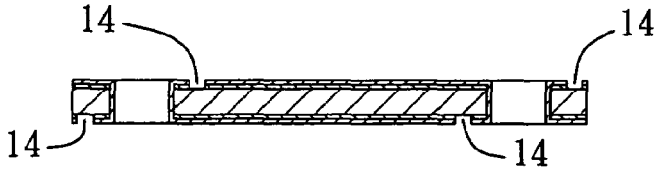
FIG. 1J (PRIOR ART)
Figure 1K:
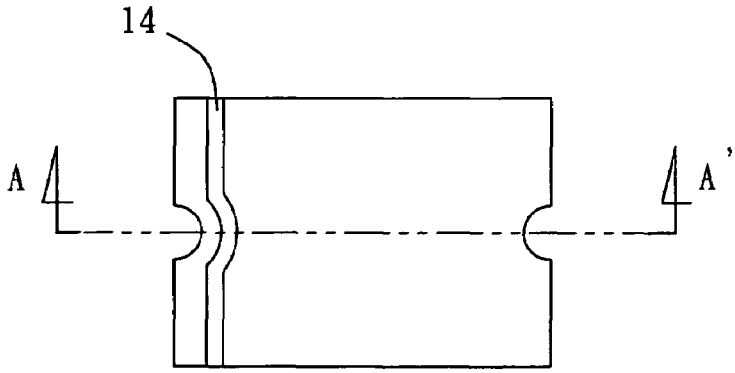
FIG. 1K (PRIOR ART)
Figure 1L:
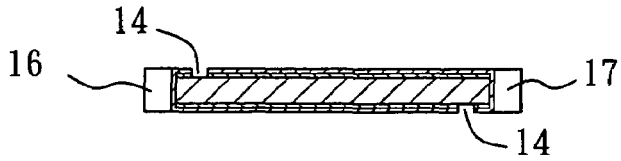
FIG. 1L (PRIOR ART)
Figure 2A:
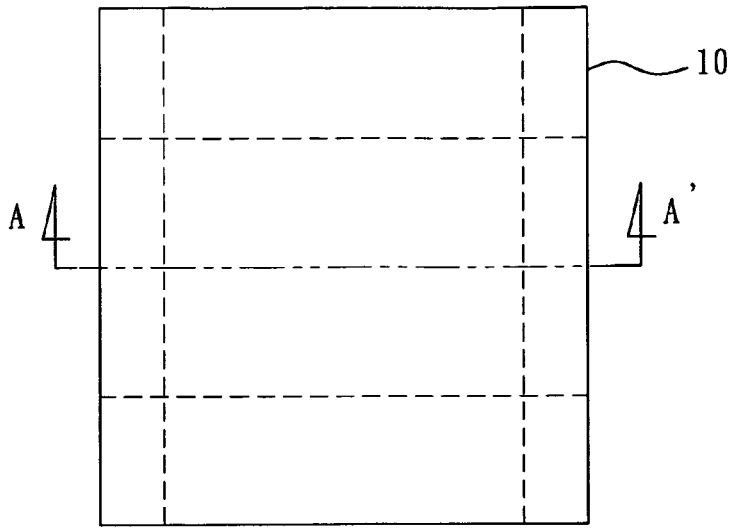
FIG. 2A, FIG. 2C, FIG. 2E, FIG. 2G and FIG. 2I are top view of structures obtained in manufacturing steps of the first embodiment of the present invention.
Figure 2B:
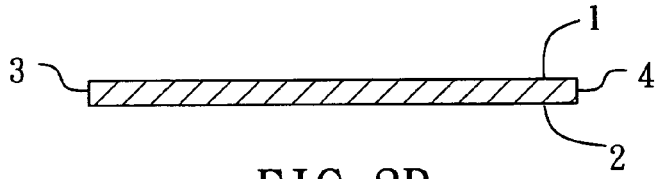
FIG. 2B, FIG. 2D, FIG. 2F, FIG. 2H and FIG. 2J are cross-section view of FIG. 2A, FIG. 2C, FIG. 2E, FIG. 2G and FIG. 2I at line A-A', respectively.
Figure 2C:
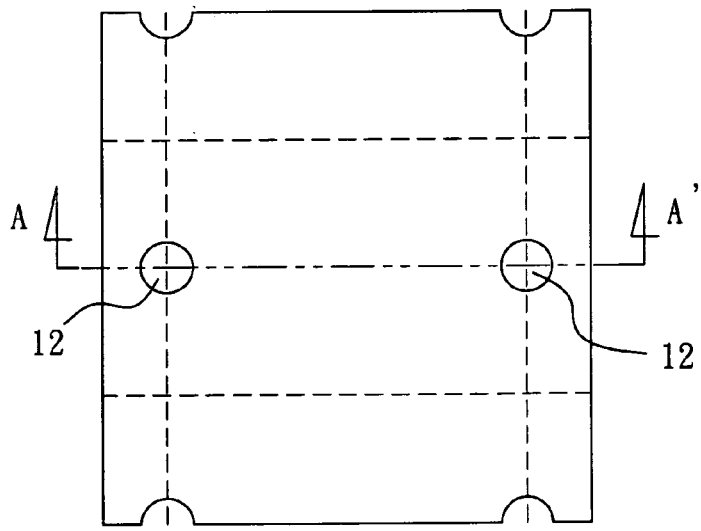
Figure 2D:
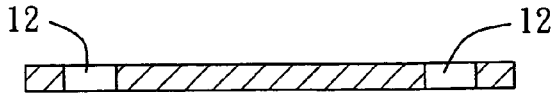
Figure 2E:
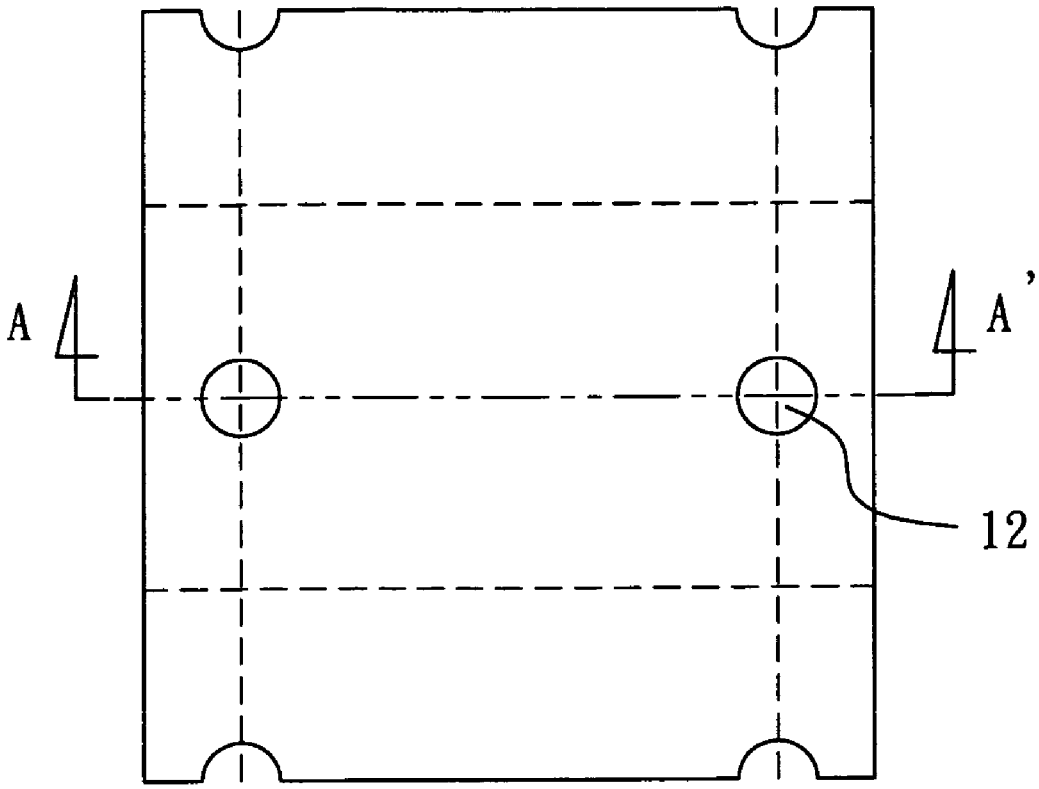
Figure 2F:
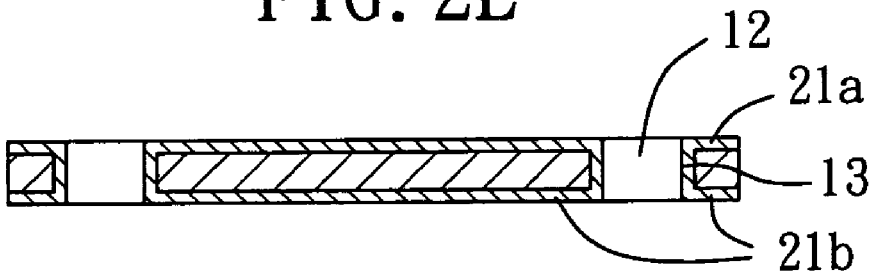
Figure 2G:
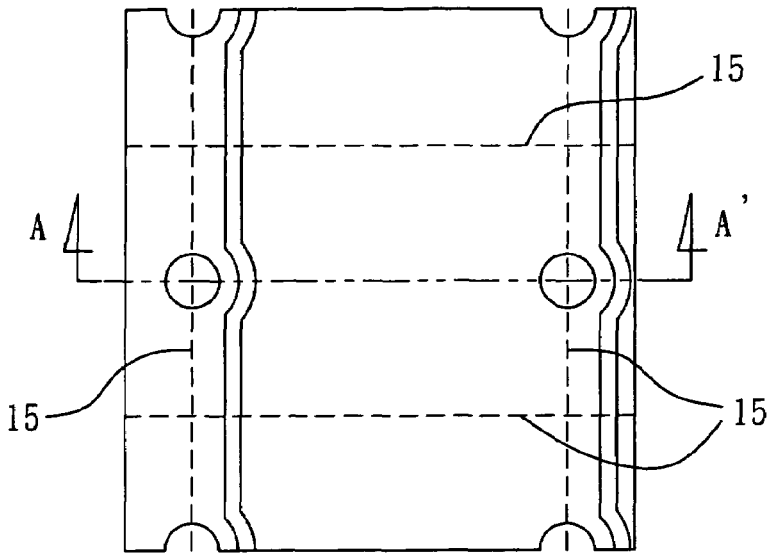
Figure 2H:
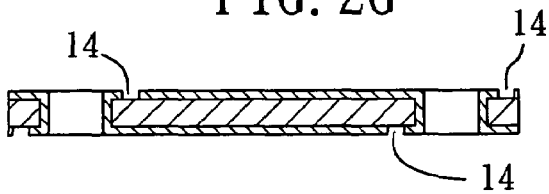
Figure 2I:
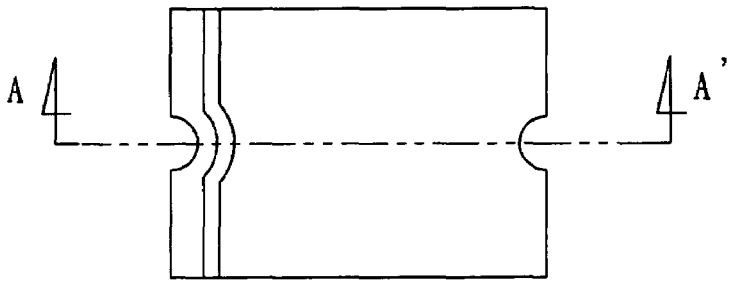
Figure 2J:
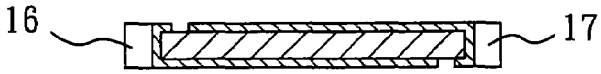

Please refer to FIGS. 2A~FIG. 2J for the first embodiment of the present invention. Vias 12 are made at predetermined locations on a parallelepiped PPTC substrate 10 which has a top surface 1, a bottom surface 2, a left surface 3 and a right surface 4, as shown in FIG. 2A and FIG. 2B. Surface treatment of the whole PPTC substrate 10 and vias are done as preparation for subsequent plating process, as shown in FIG. 2C and FIG. 2D. Subsequently, at least one metal interface layer is formed by sputtering, electroless plating (such as chemical plating). Then, an upper electrode conductive layer 21*a*, a lower electrode conductive layer 21*b*, and a connecting electrode conductive layer 13 for a thickness of at least 10 μm are formed by plating, as shown in FIG. 2E and FIG. 2F. The upper and lower electrode conductive layers are not required to use conductive metal foil. Then, as what is done in the prior art, electrode isolation areas required for terminal electrodes 16 and 17 of the chip-like resettable over-current protection device are formed, as shown in FIG. 2G and FIG. 2H. Finally, the completed conductive substrate is cut through cutting lines 15 into individual devices, as shown in FIG. 2I and FIG. 2J. Thus, the chip-like over-current protective device has separate terminal electrodes 16 and 17, and each of the terminal electrodes 16 and 17 is of a single piece.

Figure 3A:
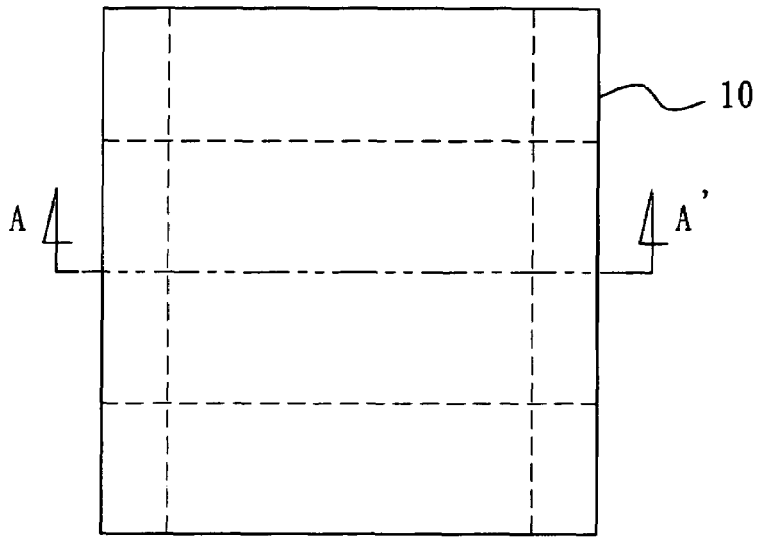
FIG. 3A, FIG. 3C, FIG. 3E, FIG. 3G and FIG. 3I are top view of manufacturing steps of second embodiment of the present invention
Figure 3B:
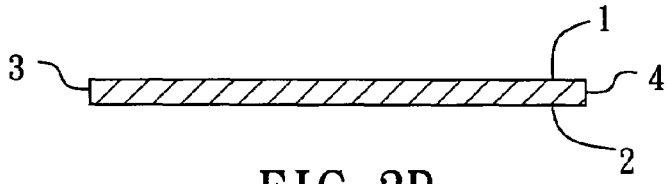
FIG. 3B, FIG. 3D, FIG. 3F, FIG. 3H and FIG. 3J are cross-section view of FIG. 3A, FIG. 3C, FIG. 3E, FIG. 3G and FIG. 3I at line A-A', respectively.
Figure 3C:
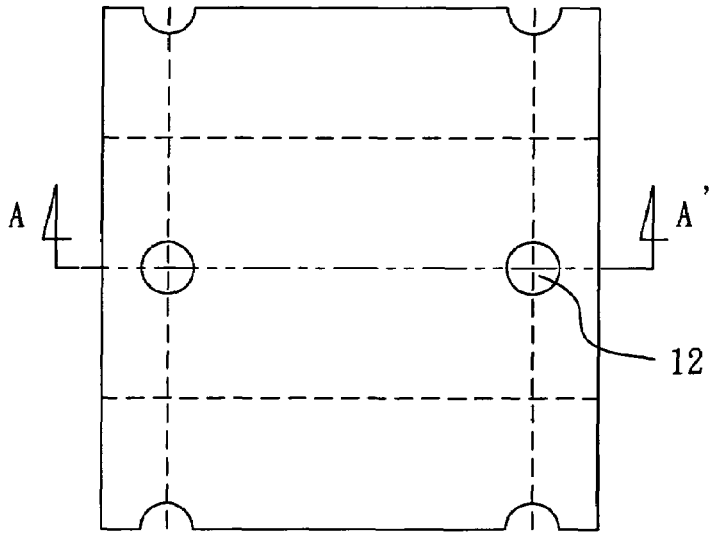
Figure 3D:
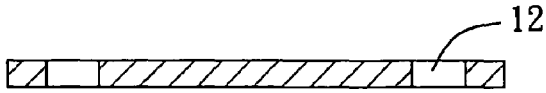
Figure 3E:
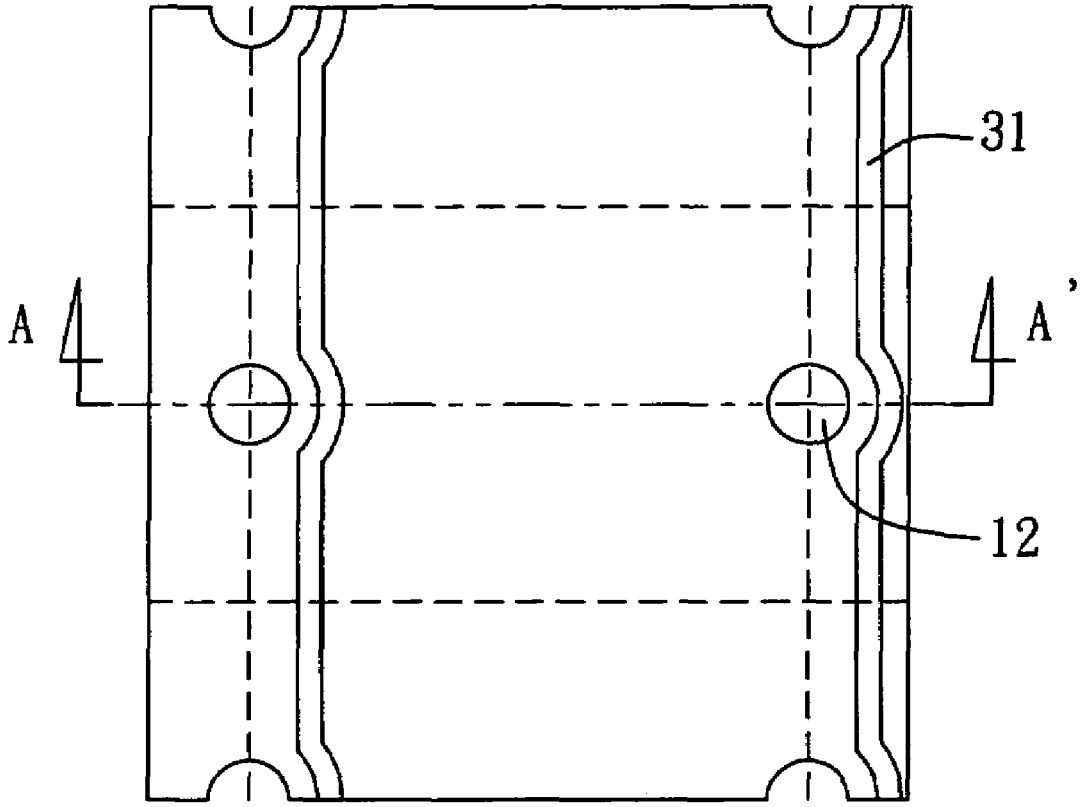
Figure 3F:
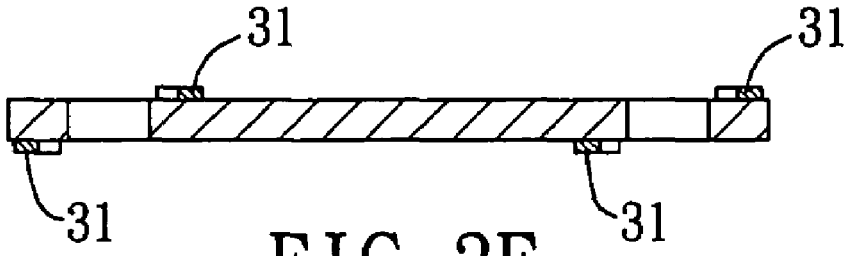
Figure 3G:
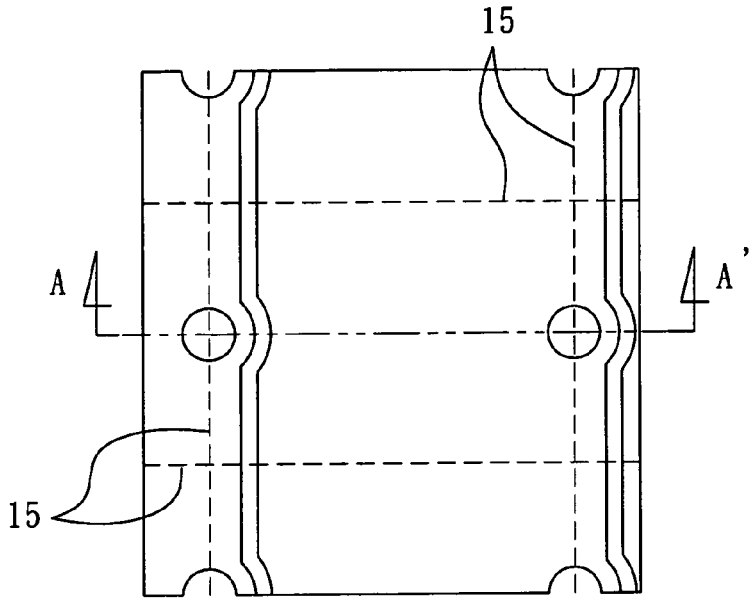
Figure 3H:
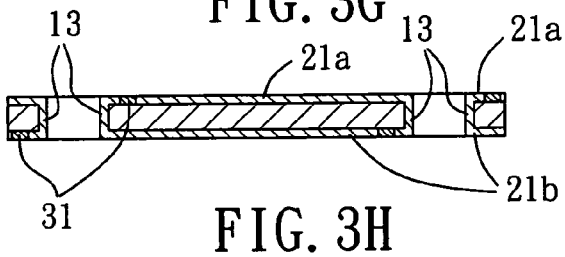
Figure 3I:
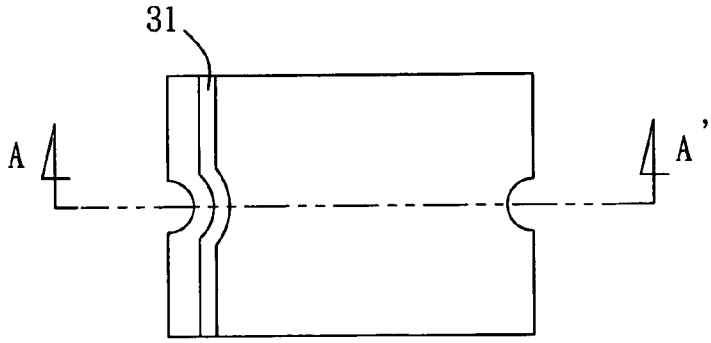
Figure 3J:
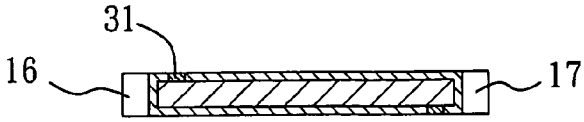

Please refer to FIG. 3A~FIG. 3J for the second embodiment of the present invention. Vias 12 are made at predetermined locations on a parallelepiped PPTC substrate 10 which has top surface 1, a bottom surface 2, a left surface 3 and a right surface 4, as shown in FIGS. 3A and 3B. Surface treatment of surfaces of the whole PPTC substrate 10 and vias are done as preparation for subsequent plating process, as shown in FIG. 3C and FIG. 3D. Next, an electrically isolated, protective layer 31 is applied on predetermined locations of electrode isolation areas, as shown in FIG. 3E and FIG. 3F. Subsequently, a mask on protective layer 31 is applied. At least one metal interface layer is deposited by sputtering, electroless plating (such as chemical plating). An upper electrode conductive layer 21*a*, lower electrode conductive layer 21*b*, and connecting electrode conductive layer 13 are deposited by electroplating technique for a thickness of at least 10 μm, as shown in FIG. 2E and FIG. 2F. After the mask is removed, the result is shown in FIG. 3G and FIG. 3H. The upper and lower electrode conductive layers 21*a* and 21*b* do not need the conventional conductive metal foil. Meanwhile, the upper and lower electrode conductive layers 21*a* and 21*b* cannot cover the protective layer 31. More preferably, the upper and lower electrode conductive layers 21*a* and 21*b* are substantially at the same level with the protective layer 31. Electrode isolation areas required by terminal electrodes 16 and 17 of the chip-like resettable over-current protective device are directly formed by the protective layer 31. Finally, the completed substrate is cut through cutting lines 15 into individual devices, as shown in FIG. 3I and FIG. 3J. Thus, the chip-like over-current protective device has separate terminal electrodes 16 and 17. Each of the electrodes 16 and 17 is of a single piece.

Figure 4A:
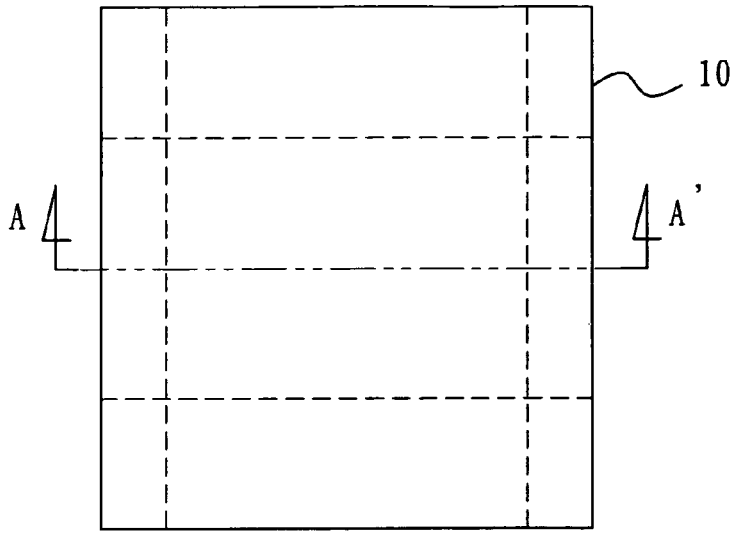
Figure 4B:
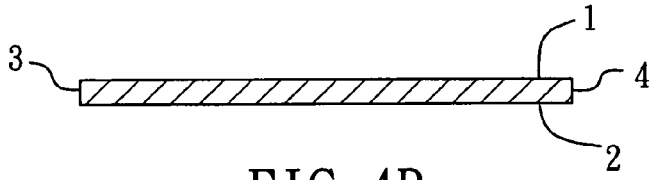
FIG. 4B, FIG. 4D, FIG. 4F, FIG. 4H, FIG. 4J and FIG. 4M are cross-section view of FIG. 4A, FIG. 4C, FIG. 4E, FIG. 4G, FIG. 4I and FIG. 4K at line A-A', respectively.
Figure 4C:
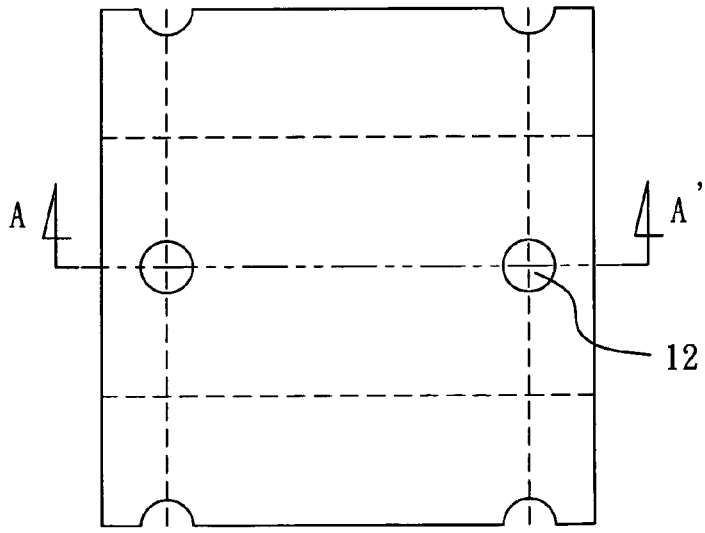
Figure 4D:
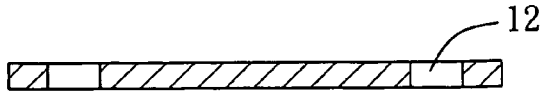
Figure 4E:
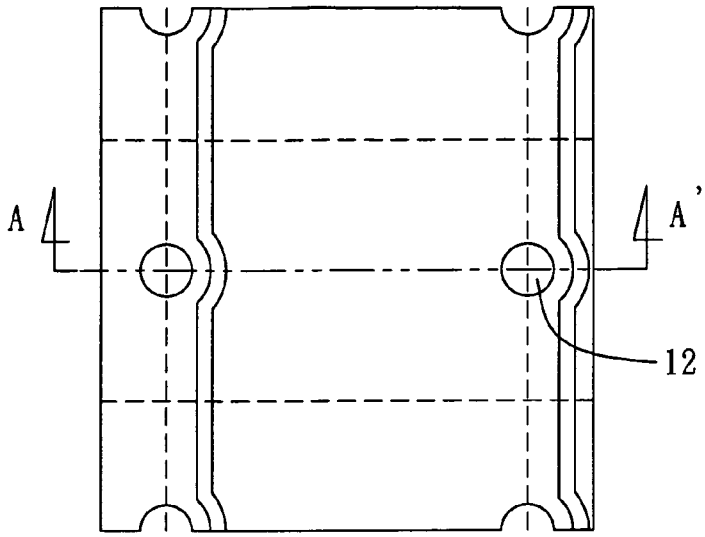
Figure 4F:
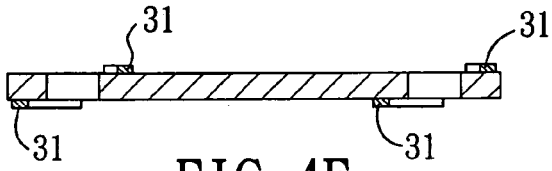
Figure 4G:
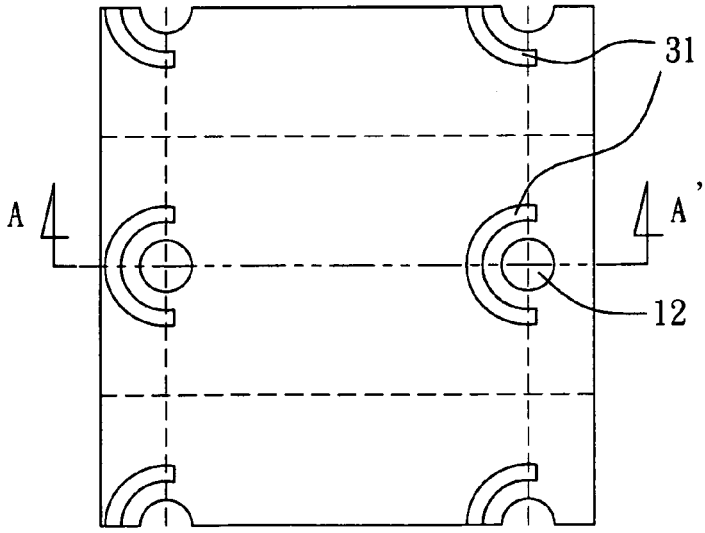
Figure 4H:
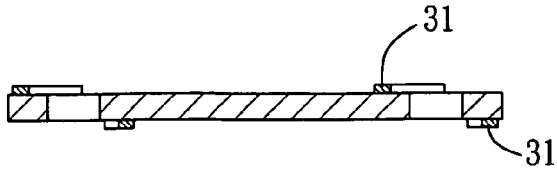
Figure 4I:
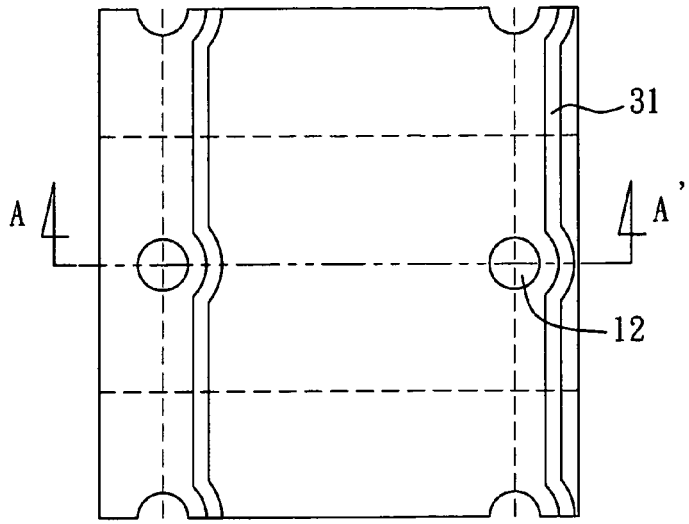
Figure 4J:
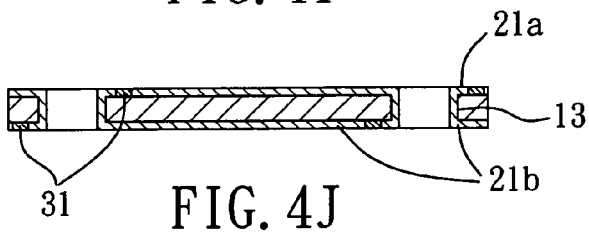
Figure 4K:
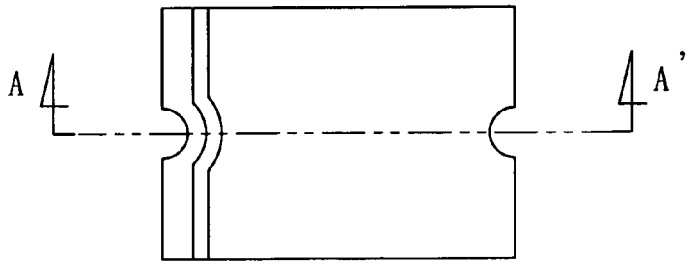
Figure 4L:
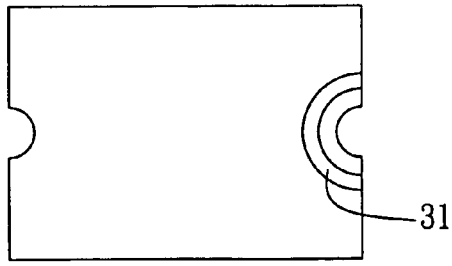
FIG. 4L is the opposite face of the same device of FIG. 4K.
Figure 4M:
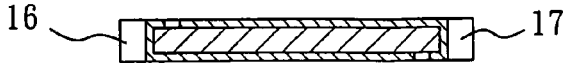

Please refer to FIG. 4A~FIG. 4M for the second embodiment of the present invention. Vias 12 are formed at predetermined locations on a parallelepiped PPTC substrate 10 which has a top surface 1, a bottom surface 2, a left surface 3 and a right surface 4, as shown in FIG. 4A and FIG. 4B. Surface treatment of surfaces of the whole PPTC substrate 10 and vias are done as preparation for subsequent plating process, as shown in FIG. 4C and FIG. 4D. Next, an electrically isolated protective layer 31 is applied on predetermined locations of electrode isolation areas, as shown in FIG. 4E and FIG. 4G. Subsequently, a mask is applied on the protective layer 31. Then at least one metal interface layer is deposited by sputtering electro-less electroplating (such as chemical plating). The upper electrode conductive layer 21*a*, lower electrode conductive layer 21*b*, and connecting electrode conductive layer 13 are deposited for a thickness of at least 10 μm, as shown in FIG. 41 and FIG. 4J. The mask covering the protective layer 31 is removed, the result is shown in FIG. 4I and FIG. 4J. The upper and lower electrode conductive layer do not need the conventional conductive metal foil. The upper and lower electrode conductive layers cannot cover said protective layer 31. More preferably, the upper and lower electrode conductive layers 21*a* and 21*b* are substantially at the same level with the protective layer 31. Electrode isolation areas required by terminal electrodes 16 and 17 of the chip-like resettable over-current protective device are directly formed by the protective layer 31. Finally, the completed conductive substrate is cut through cutting lines 15 into individual devices, as shown in FIG. 4K, FIG. 4L and FIG. 4M. The chip-like over-current protective device has separate terminal electrodes 16 and 17. Each of the terminal electrodes 16 and 17 is of a single piece.

What is claimed is:

1. A method of manufacturing a chip-like over-current protective device, comprising the steps of:

firstly, making a plurality of vias at predetermined locations of a substrate;

secondly, depositing at least one metal interface layer and then depositing at least one of conductive metal layer on surfaces of the substrate and inner walls of the vias by electroplating process;

removing said at least one conductive metal layer at predetermined locations of a plurality of electrode isolation areas so as to expose the substrate at the locations of the electrode isolation areas; and cutting the substrate through a plurality of cutting lines into a plurality of devices and said cutting lines pass through the vias so as to make the inner walls of vias to be a part of side walls of each of the devices.

2. A method of manufacturing a chip-like over-current protective device, comprising the steps of:

making a plurality of vias at predetermined locations of a substrate;

forming a plurality of electrically isolated protective layers at predetermined locations of electrode isolation areas on both sides of the substrate;

applying a mask on each of the protective layers wherein each of the masks and an associated protective layer are in the same shape and size;

depositing at least one metal interface layer and then depositing at least one conductive metal layer on both surfaces of the substrate and inner walls of the vias;

removing all the masks; and cutting the substrate through a plurality of cutting lines into a plurality of device and said cutting lines pass through the vias so as to make the inner walls of the vias part of side walls of each of the devices.

3. The method as claimed in claim 2, wherein the at least one conductive metal layer and the protective layer are substantially at the same level.

4. The method as claimed in claim 1, wherein the at least one conductive metal layer comprises a thickness of at least 10 μm.

* * * * *